US006045099A

United States Patent [19]

Aiken et al.

[11] Patent Number: 6,045,099

[45] Date of Patent: Apr. 4, 2000

[54] SUPPORT MEMBER FOR USE IN CONSTRUCTING ELECTRIFIED FENCE

[75] Inventors: James R. Aiken, Etobicoke; Allan J. Ball, Mississauga, both of Canada

[73] Assignee: Ontario Hydro, Toronto

[21] Appl. No.: 09/130,514

[22] Filed: Aug. 7, 1998

[51] Int. Cl.[7] ..... A47B 96/06

[52] U.S. Cl. ..... 248/218.4; 248/219.1; 248/219.2

[58] Field of Search ..... 248/218.4, 219.1, 248/219.2; 174/163 F, 45 R; 256/10, 19, 32, 56, 65, 11

[56] References Cited

U.S. PATENT DOCUMENTS

| | | | |
|---|---|---|---|
| 1,773,519 | 8/1930 | Cox | 256/11 |
| 2,161,944 | 6/1939 | Bauer | 256/11 |
| 3,028,147 | 4/1962 | Crumbo | 256/11 |
| 3,749,368 | 7/1973 | Miller | 256/11 |
| 3,776,522 | 12/1973 | Bartlett | 256/47 |
| 4,065,103 | 12/1977 | Sweezey | 256/11 |
| 4,159,820 | 7/1979 | Parisien | 256/11 |
| 5,662,313 | 9/1997 | Forrester | 256/11 |

*Primary Examiner*—Anita M. King
*Assistant Examiner*—David Heisey
*Attorney, Agent, or Firm*—Ridout & Maybee

[57] ABSTRACT

A support member is disclosed for use in constructing electric fences of the type having poles, electrified wires and a mesh screen. The support member is an elongated member made from an electrically non-conducting material, and has a base portion adapted and configured to connect to a pole and an arm extending away from the base portion. The arm has several apertures along its length, each aperture configured to receive the conductive wire. The arm also has a first supporting ridge, and a first flat surface for attaching the mesh thereto.

4 Claims, 2 Drawing Sheets

SUPPORT MEMBER FOR USE IN CONSTRUCTING ELECTRIFIED FENCE

FIELD OF THE INVENTION

The present invention relates to electrified fences for keeping squirrels, raccoons, and other ground dwelling animals out of enclosed areas.

BACKGROUND OF THE INVENTION

Certain facilities, such as electric transformation and distribution substations, pose a potential hazard to both the public and wildlife. Occasionally, wild animals, such as squirrels or raccoons, may enter a transformer substations and short circuit a power line causing an outage. Chain link fences have been used to isolate the public, and to some extent, wildlife from electric transformation and distribution substations. Traditional chain link fences usually consist of a wire chain link screen or screen suspended between a plurality of suspension posts. Since the chain link screens are heavy and must be tensioned to maintain their structure, the supporting posts must be anchored to the ground, often by concrete back fills. Chain link fences have not proven effective in preventing the entry of squirrels and other small animals from electric transformation substations since small animals, particularly squirrels, are able to climb over chain link fences.

Occasionally, electrified fences have been used to keep certain animals, out of hazardous areas These electric fences generally consist of a bare electrically conductive element, such as a wire or a metal bar, suspended on poles. The electric element is electrically coupled to a charging device. Occasionally, an electrified fence may have more than one conductive wire strung between the poles. To keep the electrified elements taut, tension must be applied; thus requiring the supporting poles to be anchored to the ground. Furthermore, if the electrified element must be placed at a distance from the supporting poles, specialized electrically non-conductive attachment members have to be mounted to each pole for each electrified element. These attachment members tend to require considerable labor to install since they can only support one electrified element at a time. Furthermore, traditional support members often lack the physical strength required to ensure that the electrified elements of the electric fence do not become unattached during violet storms or unauthorized entry attempts. There is a pressing need for improved support elements that make the construction of electric fences less time consuming.

SUMMARY OF THE INVENTION

The present invention is a support member for use in constructing electric fences of the type having poles, electrified wires and a mesh screen. The support member is an elongated member made from a non-conducting material, and has a base portion adapted and configured to connect to a pole and an arm extending away from the base portion. The arm has several apertures along its length, each aperture configured to receive the conductive wire. The arm also has a first supporting ridge, and a first flat surface for attaching the mesh thereto.

BRIEF DESCRIPTION OF THE FIGURES

Further features and advantages of the method and device embodying the present invention will now be described and made clearer from the ensuing description, reference being had to the accompanying drawings, in which.

DETAILED DESCRIPTION OF THE INVENTION

Figure 1:
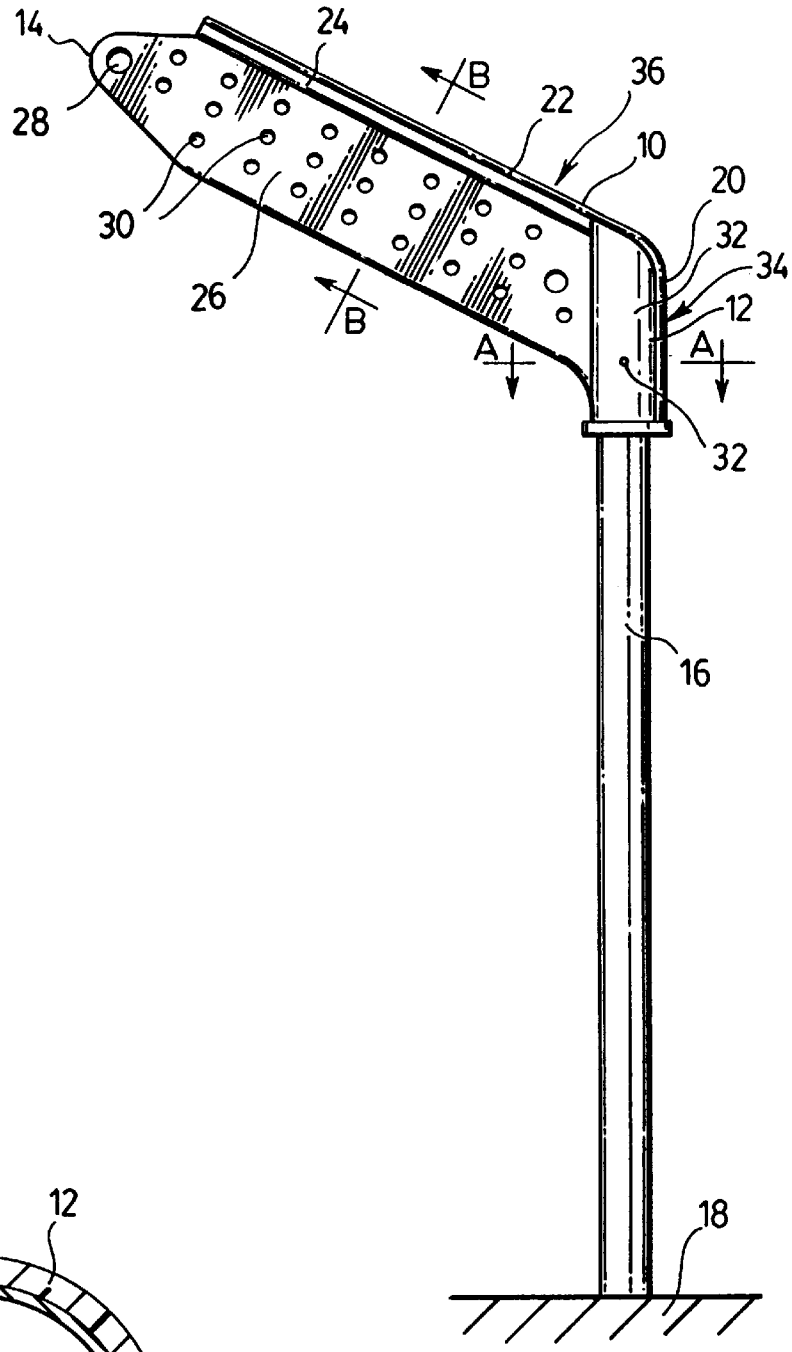
FIG. 1 is a side view of the present invention attached to a supporting pole.

Referring firstly to FIG. 1, the present invention is an elongated support member, shown generally as item 10, having base 12 and arm 14. Support member 10 is made of an electrically non-conductive material and is preferably formed as a single piece of extruded plastic. Base 12 is configured to mount directly to pole 16 which is in turn mounted to ground 18 by means known generally in the art. Arm 14 is continuous with base 12, and is formed into web 26 having ridges 22 and 24, aperture 28 and a plurality of apertures 30. Ridge 22 is perpendicular to web 26 and is provided with flat surface 36 on the side of the ridge opposite the web. Base 12 is provided with a flat surface 34, which is continuous with flat surface 36. Web 26 is positioned at a predetermined angle of approximately 120 degrees from base 12.

Figure 2:
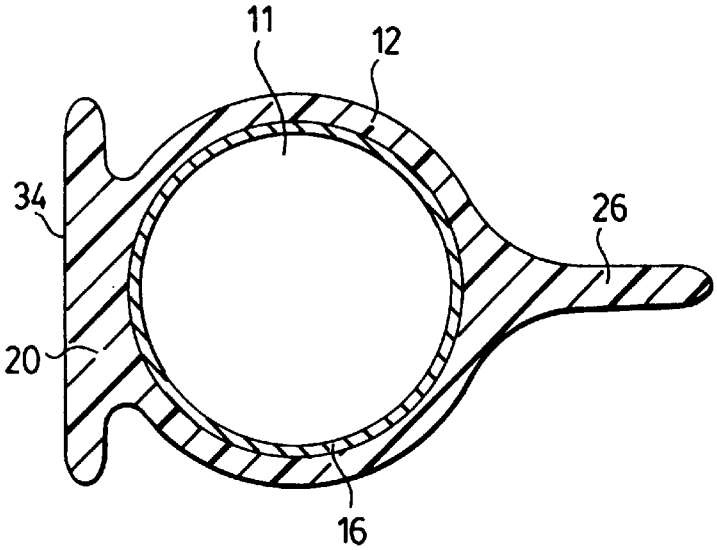
FIG. 2 is a cross sectional view of the present invention taken along line A—A of FIG. 1.

Referring now to FIG. 2, base 12 is provided with aperture 11 configured to tightly receive pole 16. While pole 16 is preferably a tubular pole, aperture 11 is also configured to snugly fit onto a standard T-bar fence post. Base 12 is also provided with rear portion 20 opposite web 26. Rear portion 20 forms a flat ridge, which stiffens base 12, permitting it to resist deformation. Rear portion 20 is provided with flat surface 34.

Figure 3:
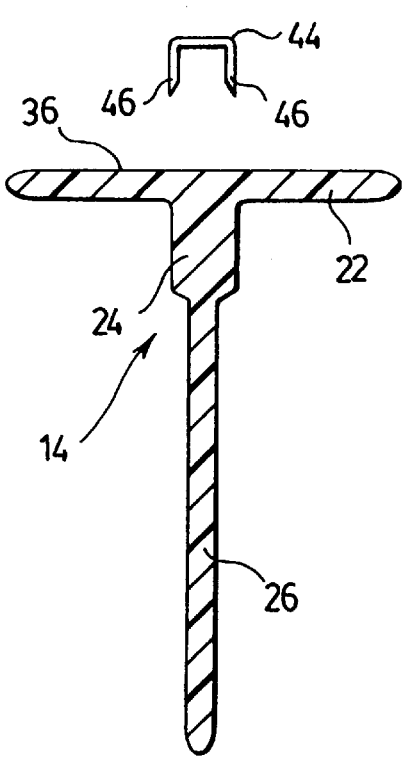
FIG. 3 is a cross sectional view of the present invention taken along line B—B of FIG. 1.

Referring now to FIG. 3, web 26 is continuous with ridges 24 and 22. Ridge 22 is positioned perpendicular to web 26 at one edge thereof. Ridge 22 is sufficiently wide to enable web 26 to resist deformation, even in high winds. Ridge 22 is provided with flat surface 36, opposite web 26. Ridge 24 is dimensioned to receive prongs 46 of staple 44, thereby allowing the staple to be rigidly secured to the center of flat surface 36.

Figure 4:
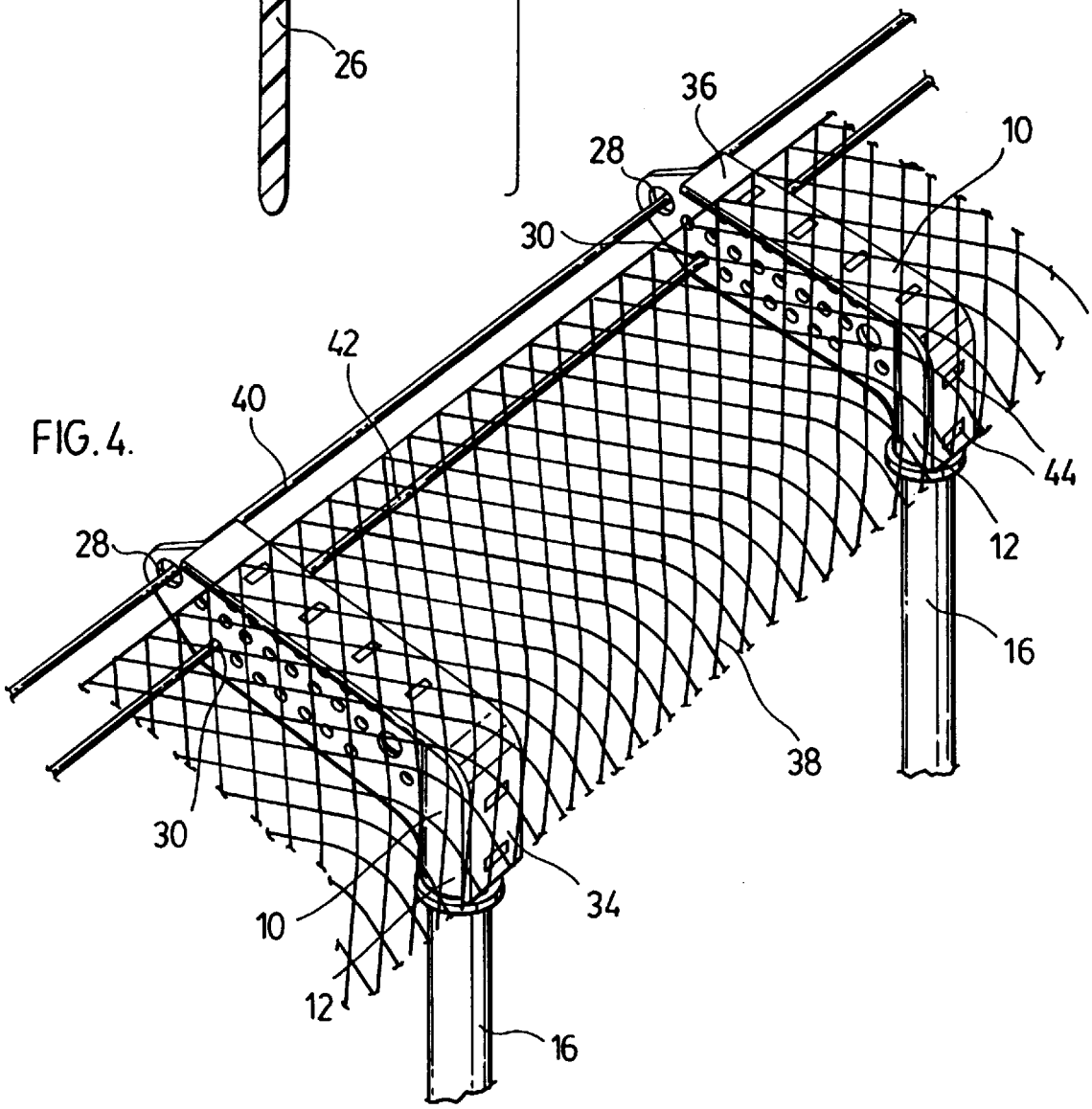
FIG. 4 is a perspective view of the present invention as used to form an electric fence.

Referring now to FIG. 4, support members 10 can be used in conjunction with poles 16 to quickly construct an electric fence. Support members 10 are first mounted to the tops of poles 16 by driving the ends of poles 16 into bases 12. If required, support members 10 can be rigidly secured to poles 16 by driving nails (not shown) through base 12 and into the poles. After a sufficient number of support members have been secured to the poles, wires 40 and 42 may be passed through apertures 28 and 30 respectively. Additional wires may be passed through apertures 30 as required. Wire mesh 38 may then be secured to support members 10 by attachment to flat surfaces 36 and 34. Flat surfaces 36 and 34 provide sufficient surface area to easily and securely attach wire mesh 38 to support member 10. Since flat surfaces 36 and 34 are continuous, attaching wire mesh screen 38 to support member 10 simply requires the mesh to be bent over the two flat surfaces and then stapled into place. Furthermore, since flat surfaces 36 and 34 are at a predetermined angle to each other, the predetermined angle can be transferred to wire mesh screen 38 by simply securing the screen to both flat surfaces. Staples 44 may be used to rigidly secure wire mesh screen 38 to flat surfaces 36 and 34. Since support member 10 is made of a non-conducting material such as plastic, wires 40, 42 and wire mesh 38 can all be electrically isolated from each other and from pole 16.

The invention having been so described, certain modifications and adaptations will be obvious to those skilled in the art. The invention includes all such modifications and adaptations which follow in the scope of the appended claims.

What is claimed is:

1. A support member for constructing an electric fence having a plurality of supporting poles, a mesh screen and at least one conductive wire comprising:

an elongated member made from an electrically non-conducting material, said member having a base portion adapted and configured to connect to one of said plurality of supporting poles and an arm extending away from the base portion, the arm having a plurality of apertures along its length, each aperture configured to receive the conductive wire, the arm comprising:

a substantially flat web extending away from the base portion, the apertures being located on the web;

a first supporting ridge extending perpendicular to the web, wherein the first supporting ridge is formed on one edge of the web and a side of the ridge opposite the web forms a first flat surface for attaching the mesh screen thereto, the web and the first supporting ridge together forming a T-shaped arm; and a second ridge positioned at the intersection of the web and the first ridge, the second ridge formed as a thickening of the web and being sufficiently wide to receive a plurality of securing members used to secure the mesh screen to the first flat surface when the support member is used to construct a fence.

2. A support member as defined in claim 1, wherein the base portion comprises a cap having a cavity, the cavity configured to fit over the end of the supporting pole.

3. A support member as defined in claim 1, wherein the base portion further comprises a second flat surface for mounting the mesh screen thereto, the second and first flat surfaces being continuous.

4. A support member as defined in claim 1, wherein the base portion comprises a cap having a cavity, the cavity configured to fit over the end of the pole and wherein the base portion further comprises a second flat surface for mounting the mesh screen thereto, the second and first flat surfaces being continuous, the arm extending at a predetermined angle from the base portion, the first flat surface being at said predetermined angle from the second flat surface.

* * * * *